US007451895B2

(12) United States Patent
Newton

(10) Patent No.: US 7,451,895 B2
(45) Date of Patent: Nov. 18, 2008

(54) DISPENSING SYSTEM

(75) Inventor: John R. Newton, Lighthouse Point, FL (US)

(73) Assignee: Global Agricultural Technology and Engineering, LLC, Vero Beach, FL (US)

( * ) Notice: Subject to any disclaimer, the term of this patent is extended or adjusted under 35 U.S.C. 154(b) by 413 days.

(21) Appl. No.: 11/245,287

(22) Filed: Oct. 6, 2005

(65) Prior Publication Data

US 2006/0086753 A1 Apr. 27, 2006

Related U.S. Application Data

(60) Provisional application No. 60/620,505, filed on Oct. 21, 2004, provisional application No. 60/636,044, filed on Dec. 14, 2004.

(51) Int. Cl.
*B65D 35/56* (2006.01)

(52) U.S. Cl. ..... 222/105; 222/94; 222/131; 222/136; 222/145.5; 222/386.5

(58) Field of Classification Search ..... 222/94–95, 222/105, 129, 129.1, 129.4, 131–136, 386, 222/386.5, 387, 399, 394, 145.5, 145.8, 145.6
See application file for complete search history.

(56) References Cited

U.S. PATENT DOCUMENTS 3,417,901 A 12/1968 Sands
3,669,313 A * 6/1972 Marand et al. ..... 222/95
4,513,884 A 4/1985 Magid
4,553,685 A 11/1985 Magid
4,870,805 A 10/1989 Morane
4,923,095 A * 5/1990 Dorfman et al. ..... 222/386.5
5,007,556 A 4/1991 Lover
5,179,982 A 1/1993 Berube et al.
5,526,957 A * 6/1996 Brown et al. ..... 222/94
5,727,713 A * 3/1998 Kateman et al. ..... 222/145.6
5,899,362 A * 5/1999 Moran ..... 222/136
6,789,699 B2 * 9/2004 Clark et al. ..... 222/94
2003/0017056 A1 1/2003 Danby et al.

FOREIGN PATENT DOCUMENTS

| | | |
|---|---|---|
| DE | 195 08 671 | 9/1996 |
| EP | 0 091 306 | 5/1988 |
| EP | 0 266 223 | 5/1988 |
| FR | 2 548 650 | 2/1984 |
| FR | 2 593 799 | 1/1986 |
| GB | 2 299 953 | 10/1996 |
| WO | WO 94/13557 | 6/1994 |
| WO | WO 99/29592 | 6/1999 |

* cited by examiner

*Primary Examiner*—Frederick C. Nicolas
(74) *Attorney, Agent, or Firm*—Gauthier & Connors LLP

(57) ABSTRACT

A liquid dispensing system comprises a container containing at least one flexible bag. A first liquid is contained in the bag. A manifold chamber is in communication with the bag via a first metering orifice, and with the interior of the container via a second metering orifice. A second liquid is introduced under pressure into the container. The thus introduced second liquid serves to pressurize the first liquid in the bag, with the first and second metering orifices serving to respectively admit metered amounts of the first and second liquids into the manifold chamber for combination into a liquid mixture dispensed through an outlet.

7 Claims, 1 Drawing Sheet

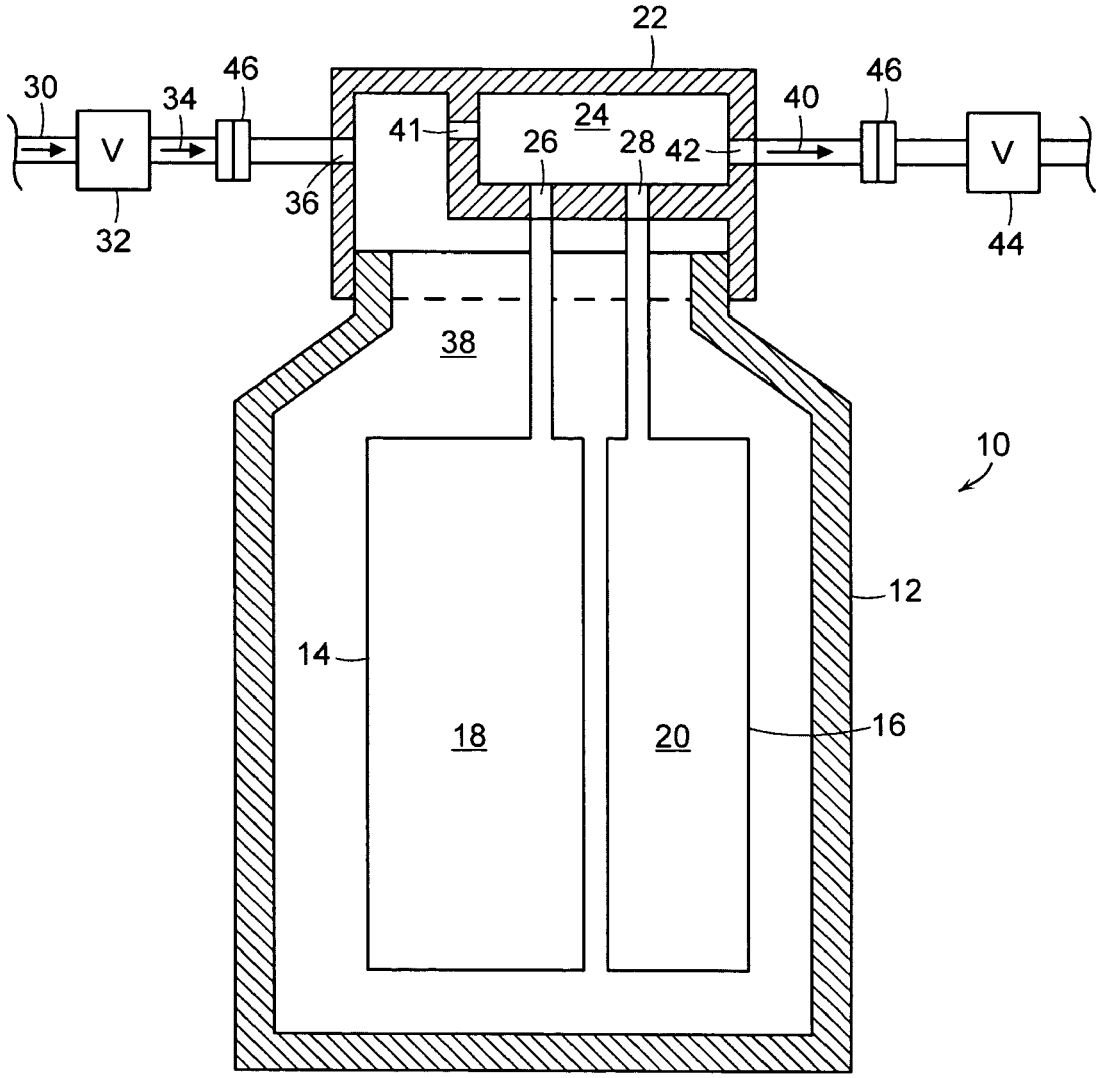
22
30
34
46
V
32
36
41
24
26
28
42
40
46
V
44
38
10
12
14
18
20
16

DISPENSING SYSTEM

REFERENCE TO RELATED APPLICATION

This application claims priority from Provisional Patent Application Nos. 60/620,505 filed Oct. 21, 2004 and 60/636,044 filed Dec. 14, 2004.

BACKGROUND DISCUSSION

1. Field of the Invention

This invention relates to liquid dispensing systems employing self-emptying containers.

2. Description of Prior Art

It is known to enclose liquid-containing flexible bags or pouches in relatively rigid containers, and to pressurize the containers to expel the liquids through metering orifices or the like. Conventionally, the containers are pressurized by liquid or gaseous mediums that vary in pressure and that are isolated from the liquids being dispensed.

SUMMARY OF THE INVENTION

The present invention departs from this conventional approach by enclosing in a container one or more flexible bags containing liquid components, with the bags and the container interior communicating with a manifold chamber via appropriately sized metering orifices. A liquid pressurizing medium is introduced at a substantially constant pressure into the container, where it serves to collapse the bags and expel metered amounts of their respective liquid components to the manifold chamber, along with a metered amount of the pressuring liquid. The metered liquid amounts are combined in the manifold chamber and delivered as a mixture.

BRIEF DESCRIPTION OF THE DRAWING

The present invention will now be described in further detail with reference to the accompanying drawing schematically depicting a preferred embodiment.

DETAILED DESCRIPTION

With reference to the drawing, a dispensing system for liquid mixture products (e.g., tea, fruit based drinks, etc.) includes a disposable unit 10 having an outer container 12. In one example, container 12 could comprise a standard one-liter plastic bottle of the type now usually used to contain soft drinks and the like. Container 12 encloses at least one, and preferably a plurality of flexible plastic bags 14 and 16 that contain liquid components 18 and 20, respectively, of a desired end product. In one example, bag 14 contains a tea concentrate syrup and bag 16 contains a fragrance essence. Container 12 has an open top through which the bags 14, 16 are received. A cap 22 closes the open container top. Cap 22 is attached to container 12, such as by threads or solvent welding. Bags 14 and 16 are in communication with a manifold chamber 24 formed within cap 22, via metering orifices 26 and 28. When bags 14 and 16 are pressurized, as described in more detail below, metered amounts of the liquid components 18 and 20 are delivered via the orifices 26, 28 into manifold chamber 24.

A supply means, typically a municipal water supply 30 is connected to cap 22 via a normally closed constant flow valve 32. Typically, the pressure of any municipal water supply will vary widely. Constant flow valve 32 isolates unit 10 from such variations by remaining open and maintaining a substantially constant selected flow and pressure downstream of valve 32 as long as the pressure of supply 30 remains above a threshold level. If the pressure of supply 30 falls below the threshold level, valve 32 closes automatically. In one example, constant flow valve 32 maintains a substantially constant flow of water 34 at three ounces per second while supply 30 varies in pressure from at least about 20 pounds per square inch to about 95 pounds per square inch. Examples of such normally closed constant flow valves are described in U.S. Pat. No. 6,026,850 and U.S. Pat. No. 6,209,578, the disclosures of which are incorporated herein by reference.

Water 34 flows from valve 32, through passageway 36 formed in cap 22, into the interior 38 of container 12. Water 34 fills and pressurizes interior 38 to about 12 psi, for example, resulting in two events. First, water 34 exerts pressure on bags 14 and 16 and expels liquid components 18 and 20 into chamber 24 via metering orifices 26 and 28. Because the pressure exerted by water 34 on bags 14 and 16 is uniform, bags 14 and 16 do not require high strength seams. Second, water 34 flows into manifold chamber 24 via a metering orifice 41. The metered amounts of the liquid components 18 and 20 and water 34 mix in chamber 24 to form the desired liquid mixture 40, such as a soft drink. The proportions of liquid components 18 and 20 and water 34 in mixture 40 are determined by the size of the metering orifices 26, 28, and 41, respectively, and the operating pressure of the water 34, which is maintained at a substantially constant level by valve 32. In one example, water 34 is mixed with a concentrate syrup at a ratio of about 150:1 and with a concentrate essence at a ratio of about 500:1. In another example, concentrate syrup flows into chamber 24 at about 6.0 cc/sec and concentrate essence 20 flows into chamber 24 at about 0.2 cc/sec. The resulting liquid mixture 40 flows out of the manifold chamber 24 through outlet passageway 42 and is dispensed via a solenoid controlled valve 44.

When either bag 14 or bag 16 is empty, container unit 10 may simply be disconnected from constant flow valve 32 and valve 44 by dry disconnect couplings 46, discarded and replaced by re-connecting the couplings 46 to a fresh unit. The units remain sealed at all times, thus safeguarding the bags 14, 16 and their contents from exposure to external contaminants as one unit is exchanged for another.

I claim:

1. A liquid dispensing system comprising:

a container;

at least one flexible bag in said container;

a first liquid contained in said bag;

a manifold chamber having an outlet, said manifold chamber being in communication with said bag via a first metering orifice, and being in communication with an interior of said container via a second metering orifice; and supply means for introducing a second liquid under pressure into said container, said second liquid serving to collapse said bag and expel the first liquid contained therein into said manifold chamber via said first metering orifice, and to exit the interior of said container into said manifold chamber via said second metering orifice for combination with the expelled first liquid to provide a liquid mixture dispensed through said outlet.

2. The liquid dispensing system of claim 1 wherein said container has an opening through which said bag is received, and wherein said manifold chamber is incorporated in a cap closing said opening.

3. The liquid dispensing system of claim 1 wherein multiple flexible bags are enclosed in said container, each of said bags containing first liquids, and each of said bags being in communication with said manifold chamber via respective first metering orifices.

4. The liquid dispensing system of claim 1 wherein said supply means includes a first valve for maintaining the second liquid introduced into said container at a substantially constant pressure.

5. The liquid dispensing system of claim 4 wherein the flow of said liquid mixture dispensed though said outlet is controlled by a second valve.

6. The liquid dispensing system of claim 5 wherein said container and said manifold comprise an integral unit detachably connected to said first and second valves by separable couplings.

7. A liquid dispensing system comprising:

a container having an open top;

a plurality of flexible bags received in said container via said open top;

first liquid components contained in said bags;

a cap closing said open top, said cap defining a manifold chamber having an outlet, said manifold chamber being in communication with said bags via first metering orifices, and being in communication with an interior of said container via a second metering orifice; and supply means for introducing a second liquid component at a substantially constant pressure into said container, said second liquid component serving to collapse said bags and expel the first liquid components contained therein into said manifold chamber via said first metering orifices, and to exit the interior of said container into said manifold chamber via said second metering orifice for combination with the expelled first liquid components to provide a liquid mixture dispensed from said manifold chamber through said outlet.

* * * * *